US007290429B2

(12) United States Patent
Kim

(10) Patent No.: US 7,290,429 B2
(45) Date of Patent: Nov. 6, 2007

(54) AUTOMATIC IDLE ADJUSTING APPARATUS WITH SIDE SHIFT FUNCTION

(75) Inventor: Yong-Myong Kim, Gunpo-si (KR)

(73) Assignee: Kia Motors Corporation, Seoul (KR)

( * ) Notice: Subject to any disclaimer, the term of this patent is extended or adjusted under 35 U.S.C. 154(b) by 89 days.

(21) Appl. No.: 11/299,357

(22) Filed: Dec. 8, 2005

(65) Prior Publication Data

US 2007/0089475 A1 Apr. 26, 2007

(30) Foreign Application Priority Data

Oct. 20, 2005 (KR) ..... 10-2005-0099069

(51) Int. Cl.
*B21D 43/20* (2006.01)

(52) U.S. Cl. ..... 72/405.08

(58) Field of Classification Search ..... 72/405.08; 248/346.06, 346.07, 278.1, 639, 678; 269/45, 269/37, 43, 60, 54.5, 71, 909, 73, 152, 910
See application file for complete search history.

(56) References Cited

U.S. PATENT DOCUMENTS 490,519 A * 1/1893 Wayland ..... 269/145
705,197 A * 7/1902 Blood ..... 29/244
1,239,620 A * 9/1917 Plotnik ..... 269/218
1,453,666 A * 5/1923 Franovich ..... 269/58
2,322,380 A * 6/1943 Mosley, Jr. ..... 269/76
3,290,039 A * 12/1966 Lancaster ..... 269/25
4,641,515 A * 2/1987 Braun et al. ..... 72/405.08
4,995,146 A * 2/1991 Woods ..... 29/281.3

FOREIGN PATENT DOCUMENTS

JP 59-163038 9/1984
JP 03-060825 3/1991
JP 05-237572 9/1993
JP 10-180378 7/1998

* cited by examiner

*Primary Examiner*—Daniel C Crane
(74) *Attorney, Agent, or Firm*—Morgan Lewis & Bockius LLP

(57) ABSTRACT

An automatic idle adjusting apparatus with a side shift function automatically adjusts the position of guides according to the kind of the workpiece provided and adjusts the distance between two workpieces processed using one metal mold. The apparatus includes two idle bases, a plurality of guides, and a plurality of three-axis moving means on the idle bases that move the guides. The three-axis moving means each comprises an X-axis guide block, a Z-axis guide block movably connected to the X-axis guide block, and a Y-axis guide block movably connected to the Z-axis guide block; one of the guides is movably connected to the Y-axis guide block. A shifting means is also provided that adjusts the distance between the idle bases.

7 Claims, 8 Drawing Sheets

AUTOMATIC IDLE ADJUSTING APPARATUS WITH SIDE SHIFT FUNCTION

CROSS-REFERENCE TO RELATED APPLICATIONS

The present application is based on, and claims priority from, Korean Application Serial Number 10-2005-0099069, filed on Oct. 20, 2005, the disclosure of which is hereby incorporated by reference herein in its entirety.

FIELD OF THE INVENTION

The present invention relates to an automatic idle adjusting apparatus with a side shift function and, more particularly, to an idle adjusting apparatus which is used for an idle step in a press device having a series of metal molds.

BACKGROUND OF THE INVENTION

Generally, a press device having a series of metal molds is configured such that each metal mold is arranged every pitch by which a workpiece is conveyed. There are many cases where an idle step exists at a position of the press device without a metal mold such that a workpiece remains idle, before the workpiece is conveyed to a next step.

The idle step requires guides so as to appropriately maintain the position and orientation of a workpiece. In order to appropriately maintain the position and orientation of the workpiece, the guides must be changed according to the kind of workpiece.

Thus, the prior art needs work for replacing the guides used in the idle step through manual labor to be suitable for a workpiece.

Meanwhile, when two workpieces are simultaneously formed by one metal mold, the two workpieces are conveyed from one step to another step while being positioned very near each other. As such, the workpieces, conveyed while being adjacent to each other, may undesirably collide in a discharge conveyor or the like. Further, it is difficult to load workpieces.

SUMMARY OF THE INVENTION

Embodiments of the present invention provide an automatic idle adjusting apparatus with a side shift function, which automatically adjusts the position of guides according to the kind of workpiece provided, thus allowing the position and orientation of the workpiece to be precisely maintained, and which automatically adjusts the distance between two workpieces processed using one metal mold.

An automatic idle adjusting apparatus with a side shift function according to an embodiment of the present invention includes two idle bases which are adjacent to each other. A plurality of guides is provided above each of the idle bases. A plurality of three-axis moving means is provided on each of the idle bases, and moves the guides relative to each of the idle bases in three directions which are at right angles to each other, thus securing the guides at predetermined positions. Further, a shifting means serves to shift the two idle bases toward or away from each other.

DESCRIPTION OF THE DRAWINGS

For a better understanding of the nature and objects of the present invention, reference should be made to the following detailed description with the accompanying drawings, in which.

DETAILED DESCRIPTION OF THE PREFERRED EMBODIMENTS

Hereinafter, a preferred embodiment of the present invention will be described with reference to the accompanying drawings.

Figure 1:
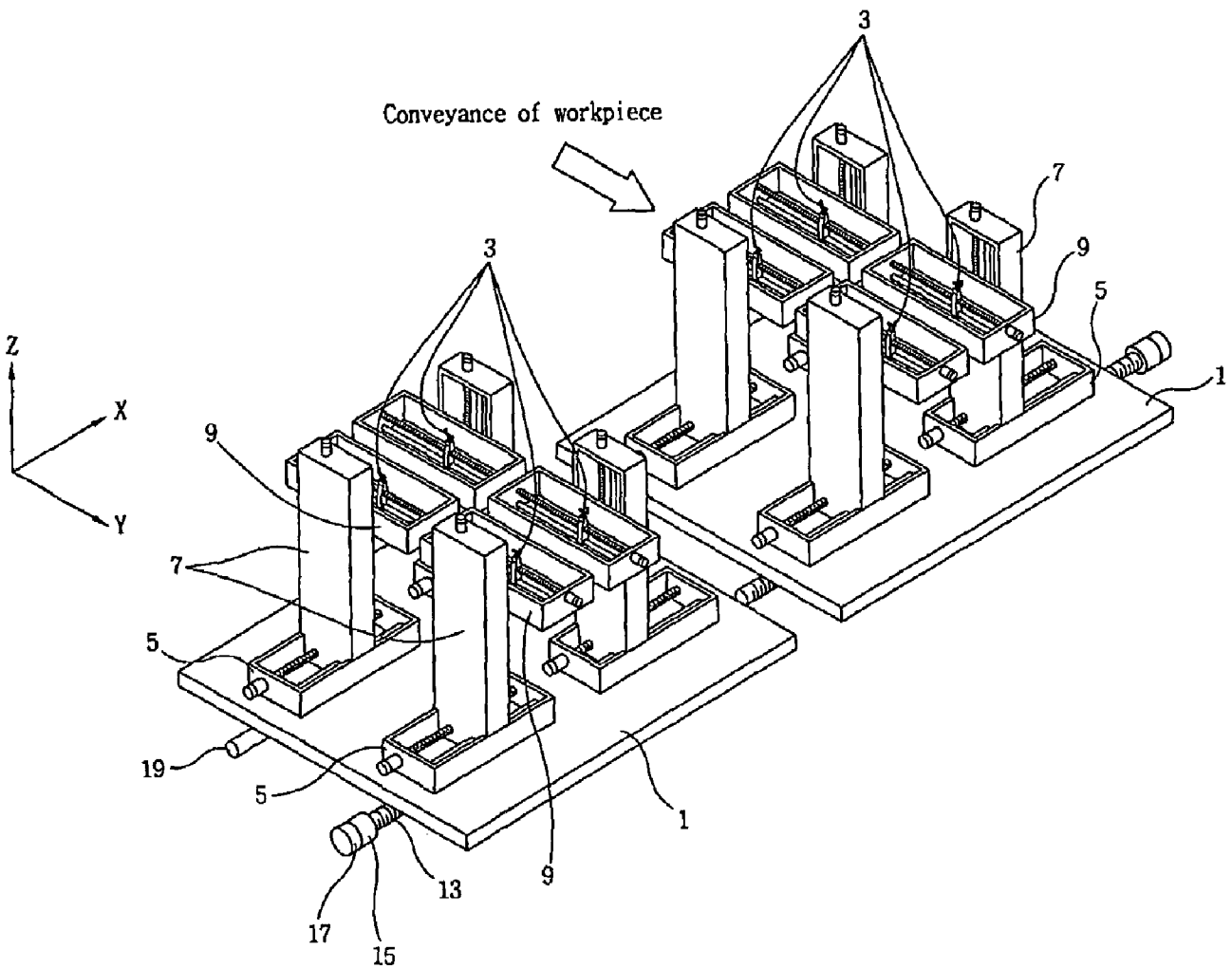
FIG. 1 illustrates an automatic idle adjusting apparatus with a side shift function, according to an embodiment of the present invention.

Referring to FIG. 1, an automatic idle adjusting apparatus with a side shift function according to an embodiment of the present invention includes two idle bases 1 which are adjacent to each other. A plurality of guides 3 is provided above each of the idle bases 1. A plurality of three-axis moving means 5, 7, 9 is provided on each of the idle bases 1, and moves the guides 3 relative to each of the idle bases 1 along three axes which are at right angles to each other, thus securing the guides 3 at predetermined positions. A shifting means serves to shift the two idle bases 1 such that the distance between the idle bases 1 is reduced or increased.

Each of the three-axis moving means includes an X-axis guide block 5 which is secured to an upper portion of each of the idle bases 1. A Z-axis guide block 7 is attached to the X-axis guide block 5 and is perpendicular to the X-axis guide block 5. An X-axis linear moving means is installed between the X-axis guide block 5 and the Z-axis guide block 7, and moves the Z-axis guide block 7 along the X-axis guide block 5 in an X-axis direction. A Y-axis guide block 9 is mounted to a side surface of the Z-axis guide block 7. A Z-axis linear moving means is installed between the Z-axis guide block 7 and the Y-axis guide block 9, and moves the Y-axis guide block 9 relative along the Z-axis guide block 7 in a Z-axis direction. A support block 11 secures and supports each of the guides 3. Further, a Y-axis linear moving means is installed between the Y-axis guide block 9 and the support block 11, and moves the support block 11 relative to the Y-axis guide block 9 in a Y-axis direction.

Figure 2:
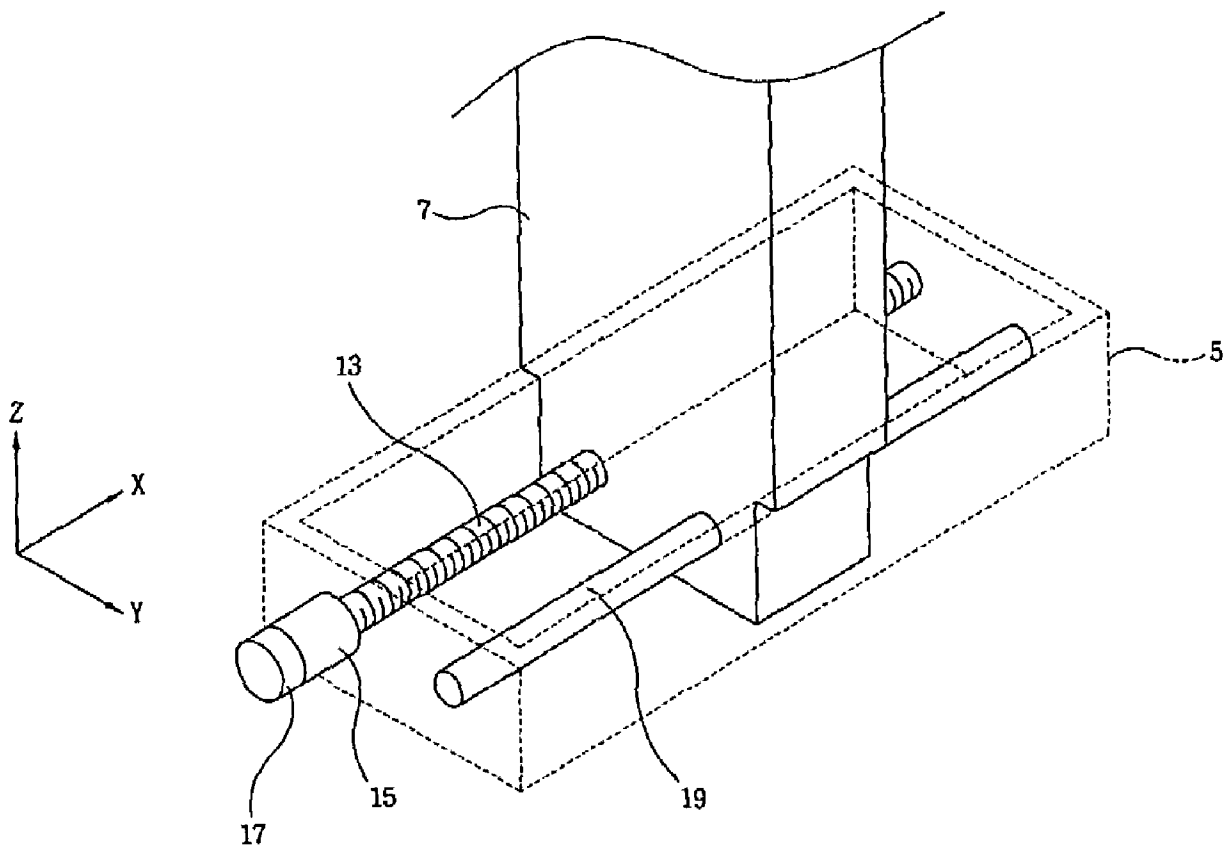
FIG. 2 illustrates an X-axis linear moving means.

As shown in FIG. 2, the X-axis linear moving means includes a lead screw 13 which is rotatably supported at both ends by the X-axis guide block 5 and is screwed to the Z-axis guide block 7. The X-axis linear moving means also includes a motor 15 and an encoder 17 to control rotation of the lead screw 13. A guide bar 19 is parallel to the lead screw 13, and passes through the Z-axis guide block 7 such that opposite ends of the guide bar 19 are supported by the X-axis guide block 5.

Figure 3:
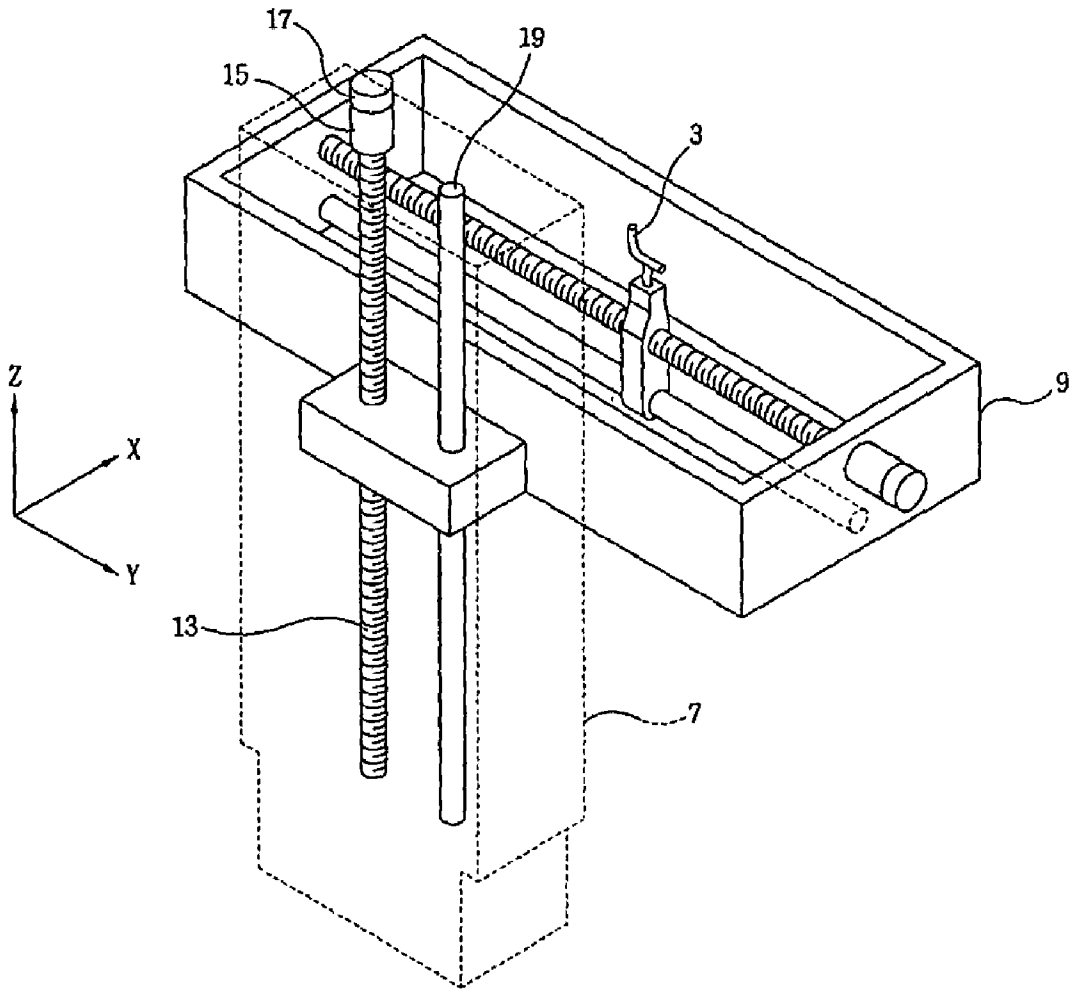
FIG. 3 illustrates a Z-axis linear moving means.

As shown in FIG. 3, the Z-axis linear moving means includes a lead screw 13 which is rotatably supported at both ends by the Z-axis guide block 7 and is screwed to the Y-axis guide block 9. The Z-axis linear moving means also includes a motor 15 and an encoder 17 to control rotation of the lead screw 13. A guide bar 19 is parallel to the lead screw 13, and passes through the Y-axis guide block 9 such that both ends of the guide bar 19 are supported by the Z-axis guide block 7.

Figure 4:
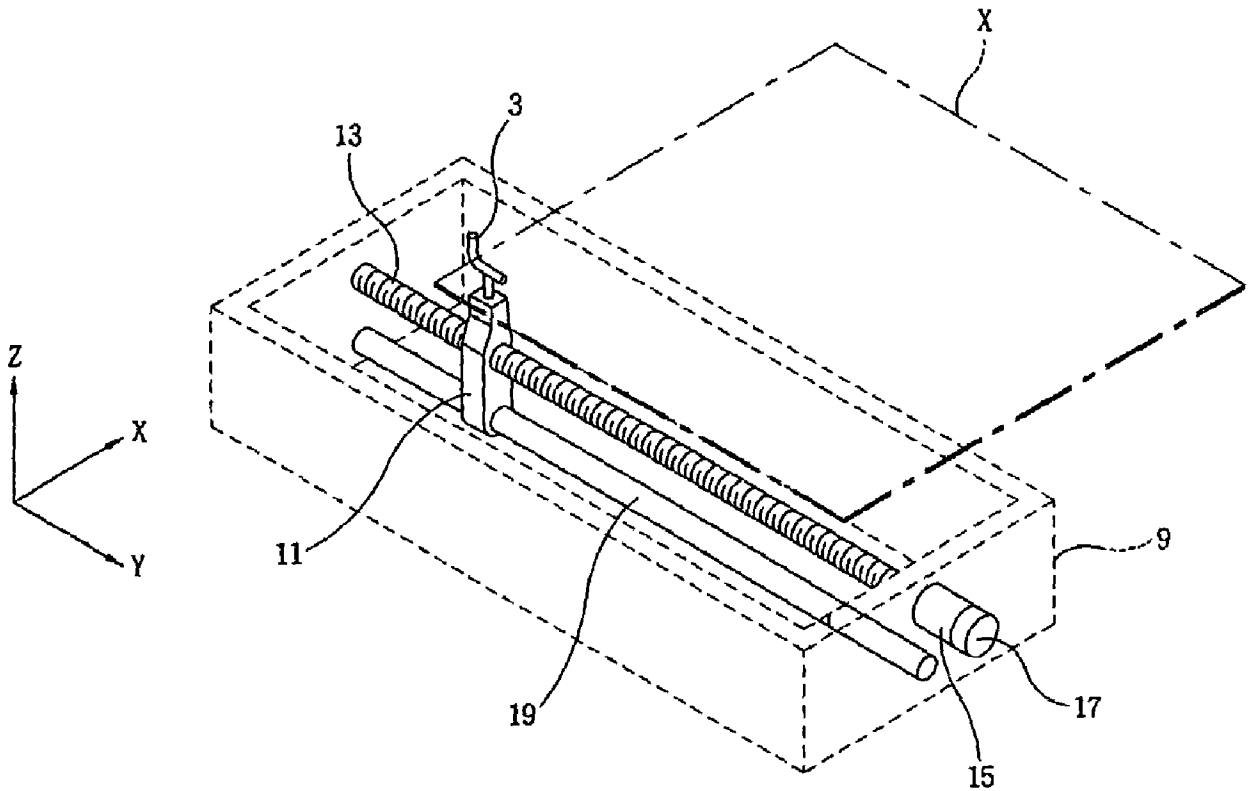
FIG. 4 illustrates a Y-axis linear moving means.

As shown in FIG. 4, the Y-axis linear moving means includes a lead screw 13 which is rotatably supported at both ends by the Y-axis guide block 9 and is screwed to the support block 11. The Y-axis linear moving means also includes a motor 15 and an encoder 17 to control rotation of the lead screw 13. A guide bar 19 is parallel to the lead screw 13, and passes through the support block 11 such that both ends of the guide bar 19 are supported by the Y-axis guide block 9.

That is, the X-axis linear moving means, the Z-axis linear moving means, and the Y-axis linear moving means have the same structure.

Figure 7:
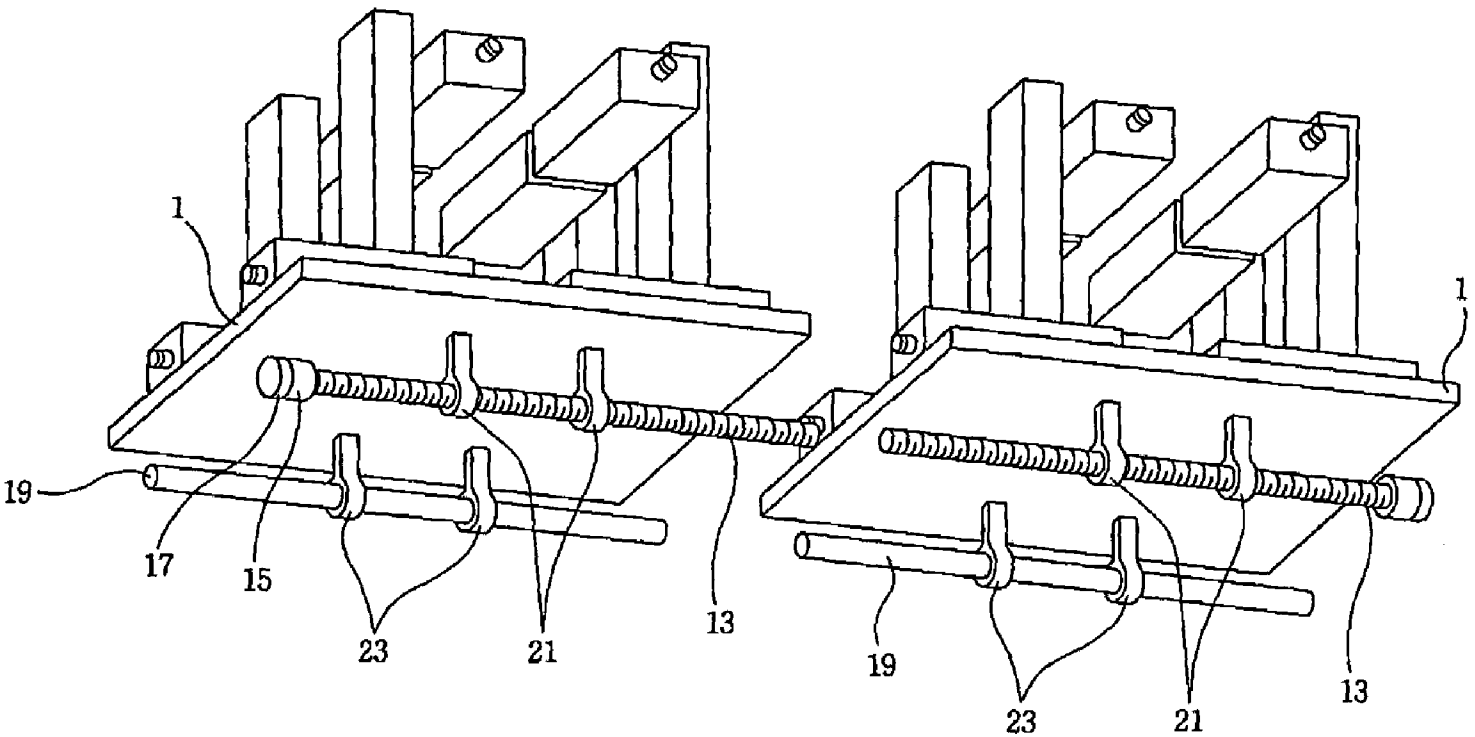
FIG. 7 illustrates a shifting means.

As shown in FIG. 7, the shifting means includes a lead screw 13 on the bottom of each of the idle bases 1, and a motor 15 and an encoder 17 which control the rotation of the lead screw 13. A guide bar 19 is parallel to the lead screw 13, and guides each of the idle bases 1. Further, screw brackets 21 protrude from the bottom of each of the idle bases 1, and are fastened to the lead screw 13. Guide brackets 23 protrude from the bottom of each of the idle bases 1 such that the guide bar 19 is supported by the guide brackets 23.

The automatic idle adjusting apparatus with a side shift function according to embodiments of the present invention is disposed where an idle step of a press device is performed.

Figure 5:
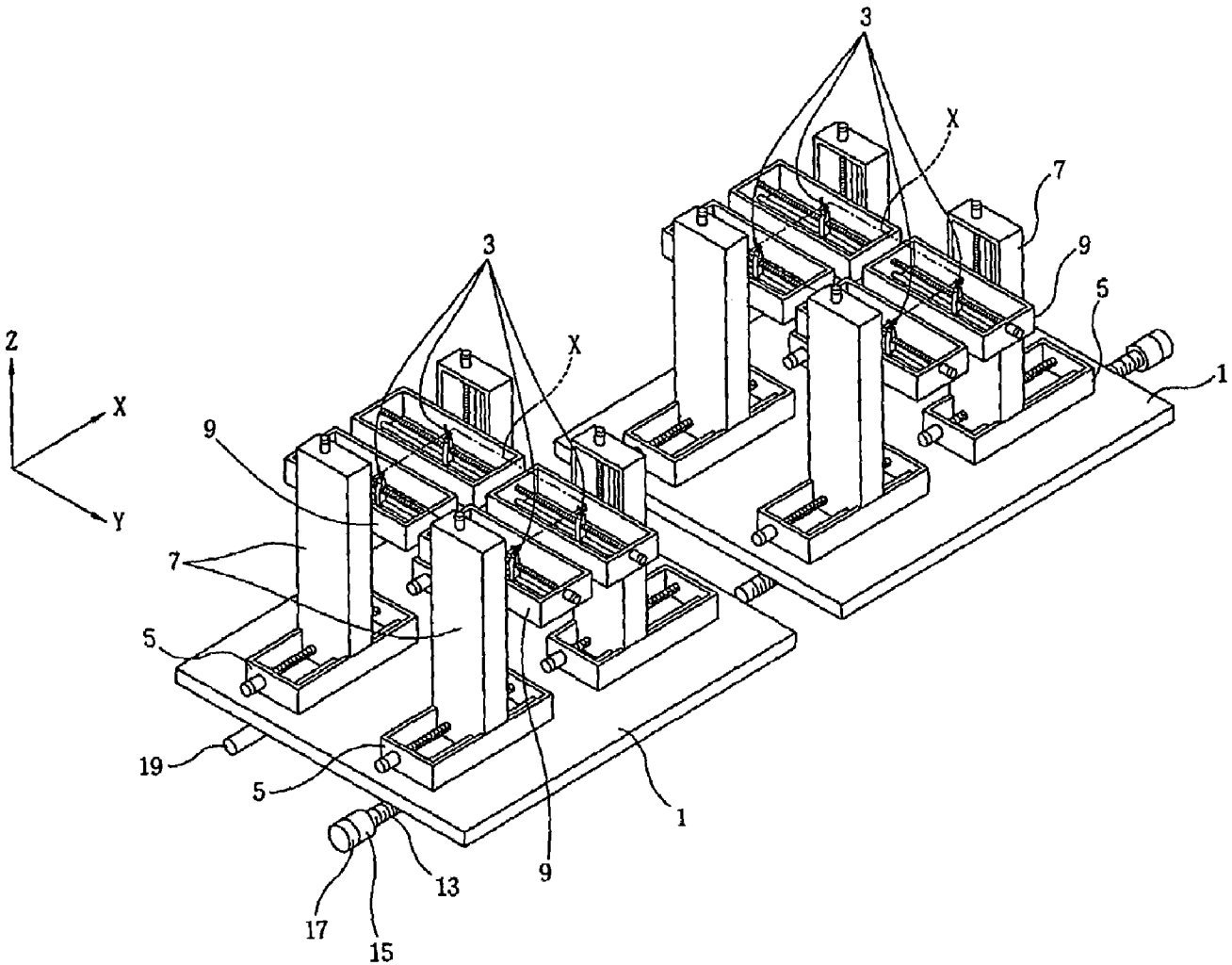
FIG. 5 depicts a workpiece loaded on an automatic idle adjusting apparatus.

As shown in FIG. 5, when a workpiece X is loaded on the automatic idle adjusting apparatus, the workpiece X is kept at a predetermined position in a predetermined orientation by the guides 3. In such a state, the workpiece X is conveyed to a subsequent step by a loader.

Figure 6:
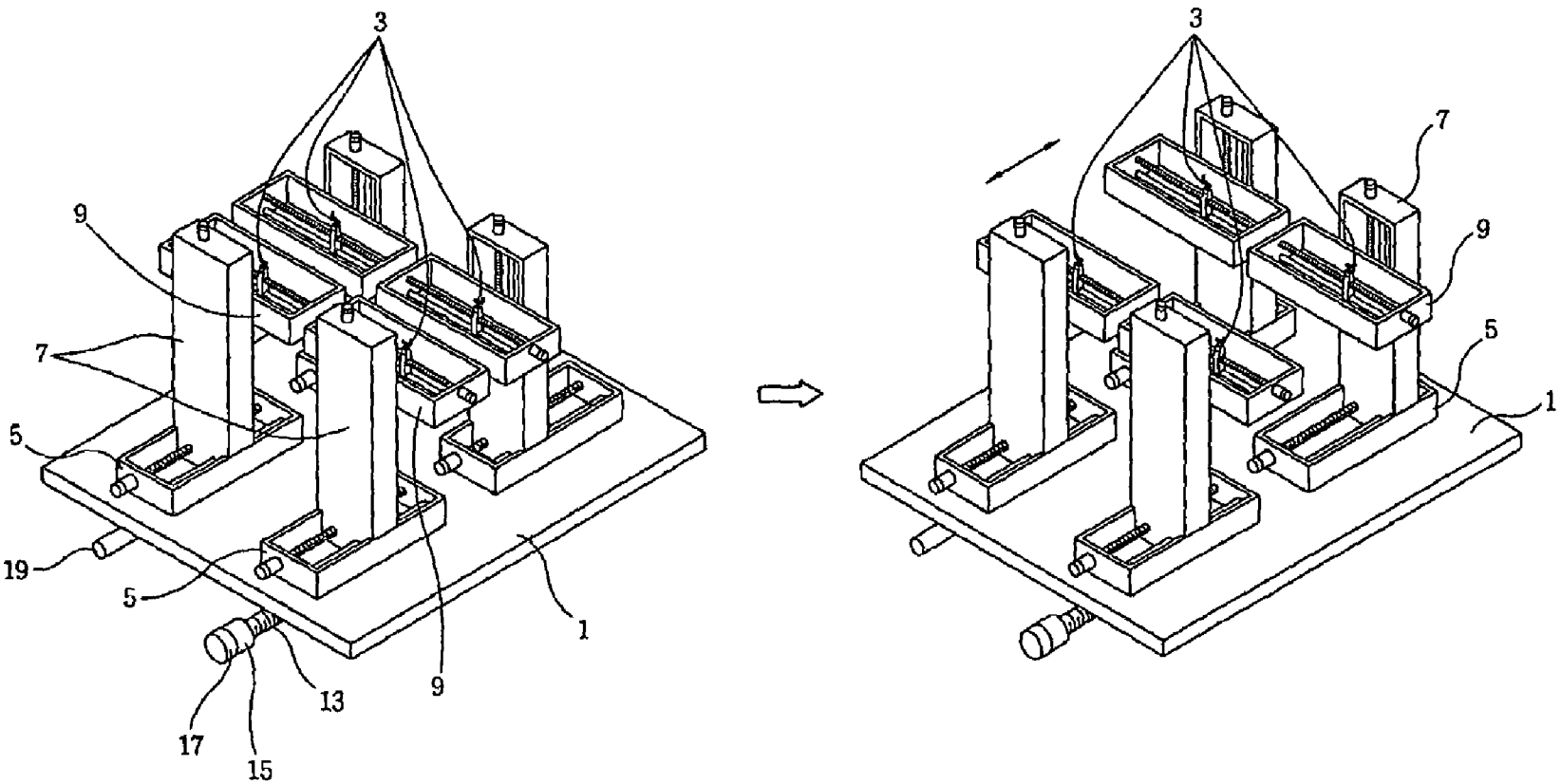
FIG. 6 illustrates three-dimensional positional variation of guides.

If the kind of workpiece X is changed, as shown in FIG. 6, the automatic idle adjusting apparatus is controlled by a controller (not shown) which is connected to the motors 15 and the encoders 17, so that the positions of the guides 3 are adjusted to correspond to the new workpiece X. The controller may comprise a processor, memory, and associated hardware, software, and/or firmware as may be selected and programmed by a person of ordinary skill in the art based on the teachings of the present invention.

The controller drives the X-axis, Z-axis, and Y-axis linear moving means using data on positions of the guides which are required for the new workpiece X. Thereby, the three-dimensional positions of the guides are reset.

Thus, the positions of the guides are automatically adjusted to correspond to the workpiece X without changing the guides manually. Therefore, the time required for work is dramatically reduced, and safety is enhanced.

Meanwhile, when two workpieces X are simultaneously processed using one metal mold and are conveyed to another step, the automatic idle adjusting apparatus of this invention also performs the side shift function which automatically adjusts the distance between the two workpieces X.

Figure 8:
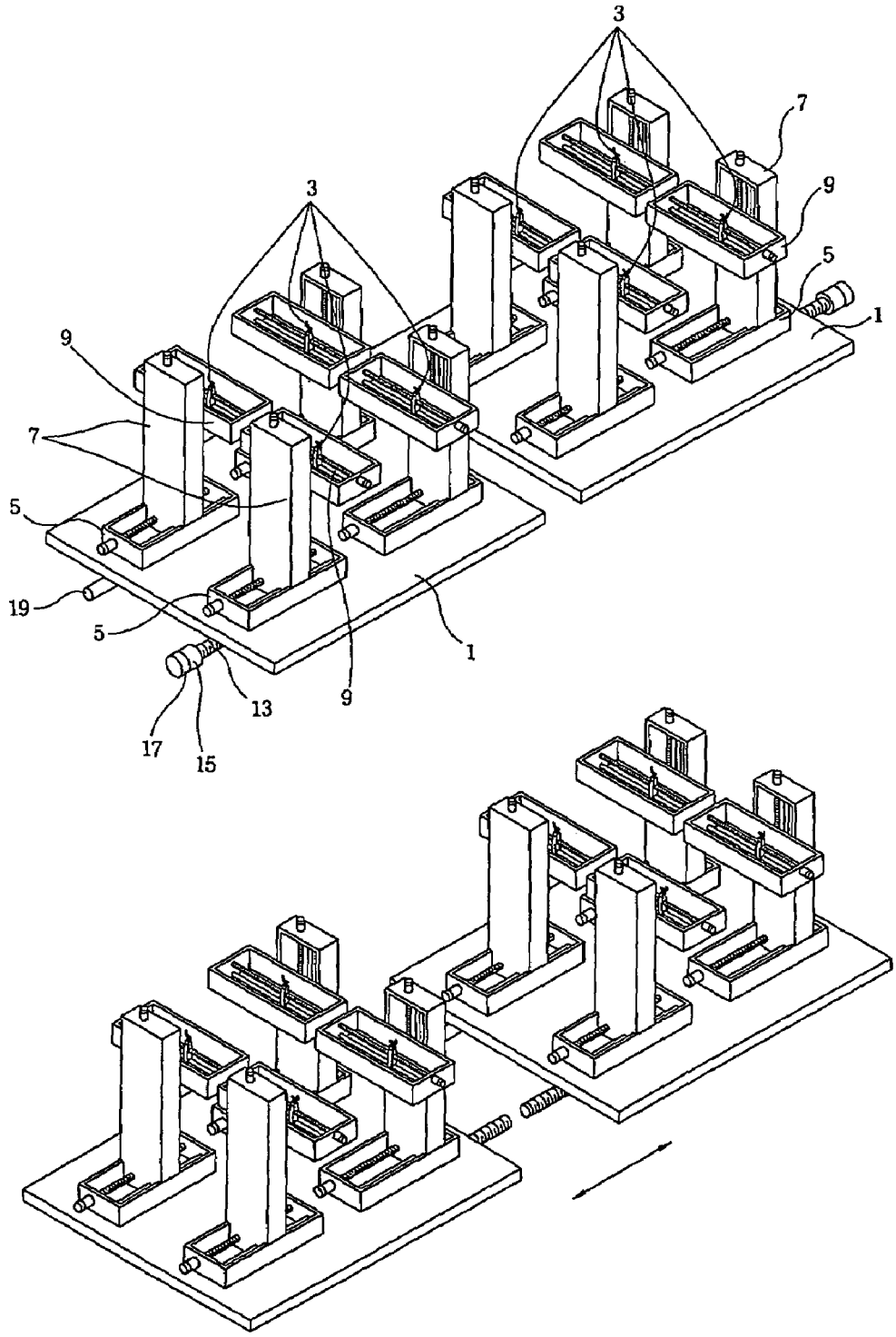
FIG. 8 illustrates a side shifting operation.

When the two workpieces X are fed into the two idle bases 1, the lead screws 13 of the shifting means are rotated, so that the distance between the idle bases 1 is increased or decreased. In such a state, the loader conveys the workpieces X to a next step. After the workpieces X are removed from the idle bases 1, the lead screws 13 are rotated reversely such that a new workpiece X may be fed to the automatic idle adjusting apparatus by an unloader again. Thus, the present invention allows two workpieces X to be conveyed to a next step while a large distance is maintained between the objects (see FIG. 8).

As apparent from the foregoing, the present invention provides an automatic idle adjusting apparatus, which is constructed so that the position and orientation of a workpiece are precisely maintained by automatically adjusting the position of guides, according to the kind of the workpiece passing through an idle step, and which has a side shift function for maintaining a large distance between two workpieces processed using one metal mold, thus shortening the time required for work, enhancing the safety of a worker, preventing collisions between workpieces, and allowing the workpieces to be easily loaded.

What is claimed is:

1. An idle adjusting apparatus for an idle step in a press before a workpiece is conveyed to the press, comprising:
- two idle bases;
- a plurality of guides for maintaining an orientation of the workpiece; and
- a plurality of guide-moving means provided on each of the idle bases and attached to the plurality of guides, wherein each of said plurality of guide-moving means comprises:
  - a first guide block attached to an upper portion of one of said idle bases;
  - a second guide block;
  - a first linear moving means that movably connects the second guide block to the first guide block;
  - a third guide block;
  - a second linear moving means that movably connects the third guide block to the second guide block;
  - a support block attached to one of the plurality of guides; and
  - a third linear moving means that movably connects the support block to the third guide block.

2. The idle adjusting apparatus as defined in claim 1, further comprising a means for shifting the two idle bases toward and away from each other.

3. The idle adjusting apparatus as defined in claim 1, wherein each of said first, second, and third guide blocks is substantially perpendicular to each other.

4. The idle adjusting apparatus as defined in claim 1, wherein said first linear moving means comprises:
- a lead screw rotatably supported by the first guide block, and attached to the second guide block;
- a means for controlling rotation of the lead screw; and
- a guide bar substantially parallel to the lead screw, passing through the second guide block, and supported by the first guide block.

5. The idle adjusting apparatus as defined in claim 1, wherein said second linear moving means comprises:
- a lead screw rotatably supported by the second guide block, and attached to the third guide block;
- a means for controlling rotation of the lead screw; and
- a guide bar substantially parallel to the lead screw, passing through the third guide block, and supported by the second guide block.

6. The idle adjusting apparatus as defined in claim 1, wherein said third linear moving means comprises:
- a lead screw rotatably supported by the third guide block, and attached to the support block;
- a means for controlling rotation of the lead screw; and
- a guide bar substantially parallel to the lead screw, passing through the support block, and supported by the third guide block.

7. The idle adjusting apparatus as defined in claim 2, wherein said means for shifting the two idle bases comprises:
- two lead screws, each provided on a bottom of one of the idle bases;
- a means for controlling rotation of the two lead screws; and
- two guide bars, each substantially parallel to one of said lead screws, and attached to one of said idle bases.

* * * * *